United States Patent [19]

Head

[11] 4,324,015

[45] Apr. 13, 1982

[54] SWIMMING POOL TILE CLEANING DEVICE

[76] Inventor: Earl C. Head, 9461 Goodman Rd., Olive Branch, Miss. 38654

[21] Appl. No.: 142,769

[22] Filed: Apr. 22, 1980

[51] Int. Cl.[3] ..... E04H 3/20

[52] U.S. Cl. ..... 15/49 C; 15/1.7

[58] Field of Search ..... 15/1.7, 21 E, 49 R, 15/49 C, 50 R, 50 C, 98

[56] References Cited

U.S. PATENT DOCUMENTS

| | | | |
|---|---|---|---|
| 1,947,435 | 2/1934 | Richmond | 15/50 R |
| 2,294,814 | 9/1942 | Thrailkill | 15/49 R |
| 2,684,495 | 7/1954 | Litkenhous | 15/49 R |
| 3,562,832 | 2/1971 | Rickard | 15/21 E |
| 4,122,576 | 10/1978 | Bevington et al. | 15/49 R |

FOREIGN PATENT DOCUMENTS

| | | | |
|---|---|---|---|
| 2138194 | 3/1973 | Fed. Rep. of Germany | 15/1.7 |

*Primary Examiner*—Edward L. Roberts

*Attorney, Agent, or Firm*—Harvey B. Jacobson

[57] ABSTRACT

The device includes a handle attached to a housing having transverse tandem wheels which ride along the upper perimeter of the pool. The housing includes an offset portion extending over the pool itself and mounts a depending rotary brush which contacts the upper vertical wall surface of the pool at the waterline for cleaning the tiles of the pool wall.

6 Claims, 4 Drawing Figures

90
18
10
12
30
14
70
16
68
95

10
14
16
12

32
3
3
16

SWIMMING POOL TILE CLEANING DEVICE

BACKGROUND OF THE INVENTION

1. Field of the Invention

This invention relates to devices for cleaning the tiles of swimming pool walls and especially to such devices adapted for cleaning swimming pool walls just at and above the waterline.

2. Discussion of Related Art

It is well known that the walls of swimming pools in the area at and above the waterline are prone to collect dirt and grease which floats on the water thus making this area of the pool unusually dirty, unsightly and difficult to clean. The usual method of cleaning this area of a wall is to use a hand brush and apply vigorous movement and pressure to the brush. This proves to be an arduous task and, accordingly, an alternate means of cleaning swimming pool walls would be desirable.

One attempt to provide an implement for cleaning the walls of a swimming pool can be seen in U.S. Pat. No. 3,471,884, issued Oct. 14, 1969 to Wright. The Wright patent shows a brush mounted on a disc which is rotated by a helical impeller vane disposed in the return duct of the pool filtration system.

Other cleaning implements are also known. For instance, U.S. Pat. No. 3,196,473, issued July 27, 1965 to Bell, and U.S. Pat. No. 3,402,414, issued Sept. 24, 1968, also to Bell, show grill cleaning devices having motor-driven brushes for scraping grease and grime from the surface of a cooking grill. U.S. Pat. No. 2,812,529, issued Nov. 12, 1957 to Payne, shows a motor-driven brush which is designed for removing loose paint from a surface to be painted. U.S. Pat. No. 3,751,749, issued Aug. 14, 1973 to Wilson, shows a gutter cleaning device for cleaning the gutters on a house. The Wilson device includes tandem wheels disposed transversely of a housing for allowing the housing to ride along a roof with a cleaning implement disposed within the gutter.

SUMMARY OF THE INVENTION

One object of the present invention is to provide a cleaning device for swimming pools which effectively cleans the area and tiles located in a pool at and above the waterline of the pool.

A further object of the present invention is to provide a pool tile cleaning device which can be operated from a standing position on the perimeter of the swimming pool.

An even still further object of the present invention is to provide pool tile cleaning device which comprises a minimum number of components yet is durable in construction and effective for its intended purpose.

In accordance with the above objects, the present invention comprises a housing having a generally vertically disposed portion which rests upon a pair of transverse tandem wheels which wheels can easily ride upon the perimeter of a swimming pool. The vertically disposed portion of the housing contains in its upper part an electric motor having a downwardly projecting shaft mounting a drive pulley. The motor is mounted within the housing in a position over the tandem wheels to allow the device to be balanced by an operator. An offset portion extends from the housing and contains a brush shaft which depends therefrom for driving a cleaning brush. The brush is mounted on a shaft by collars attached to the shaft and can slide therealong for selectively adjusting the height of the brush. A belt and pulley connect the brush shaft to the motor shaft. A handle having an on/off switch is attached to the vertical housing portion and extends away from the offset portion to allow an operator to push the device along the perimeter of a swimming pool thereby cleaning the tiles in the vicinity of the waterline.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
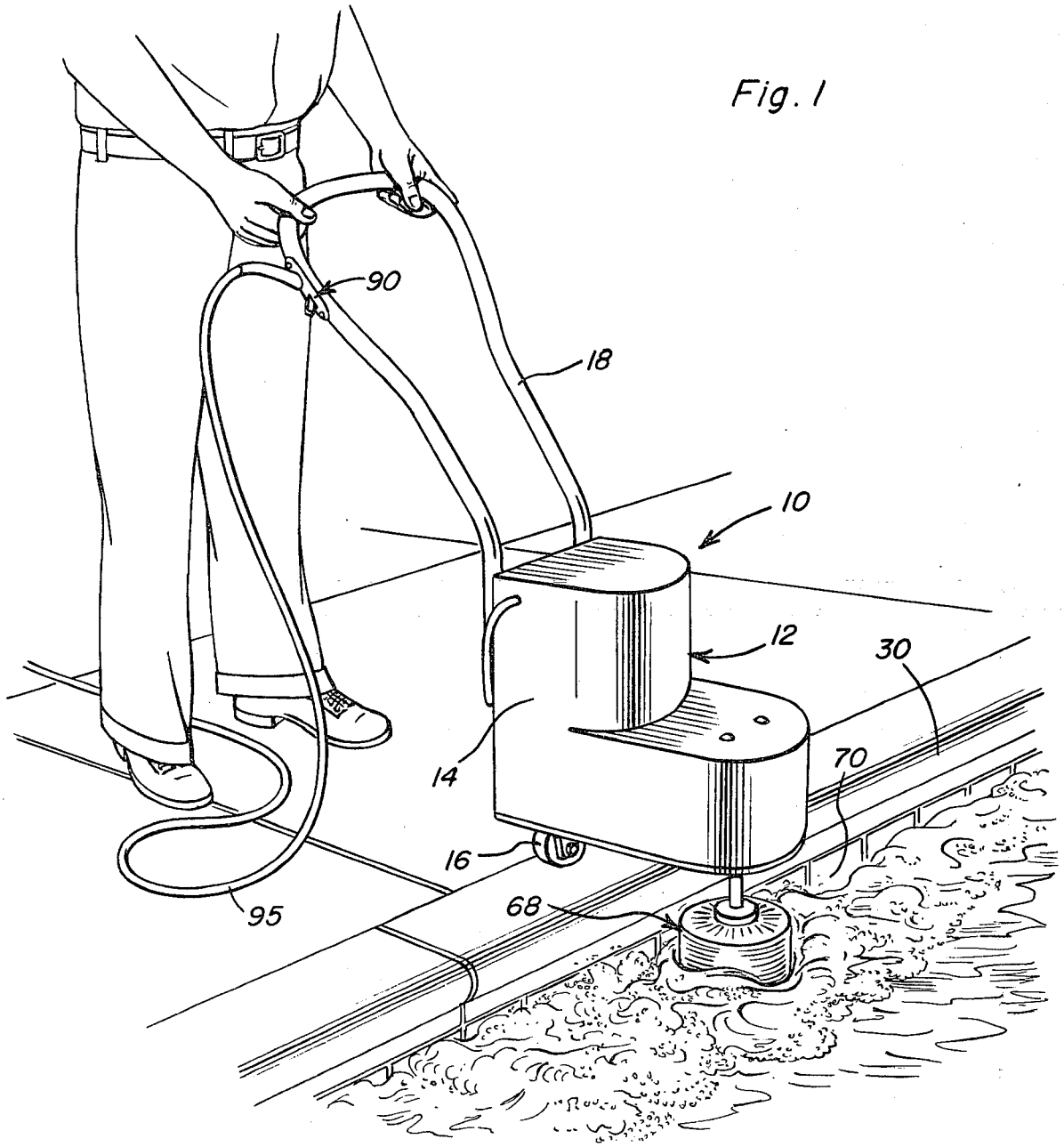
FIG. 1 is a perspective view of the swimming pool tile cleaning device in operation.
Figure 2:
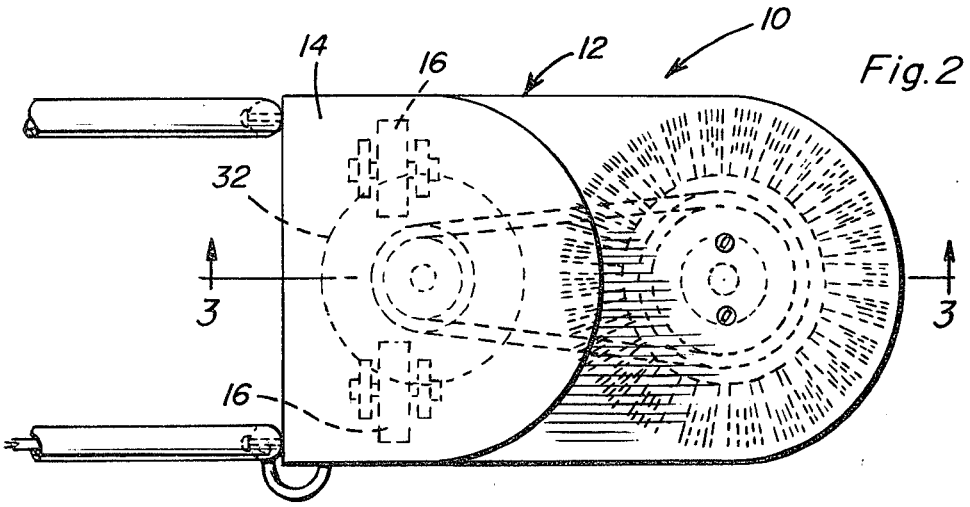
FIG. 2 is a top plan view of the swimming pool tile cleaning device.

Now with reference to the drawings, a pool tile cleaning device incorporating the principles and concepts of the present invention and generally referred to by the reference numeral 10 will be described in detail.

Device 10 includes a housing 12 having an upright section 14 mounted over transversely oriented tandem wheels 16. A handle 18 is mounted to the rear wall 20 of upright section 12 by any suitable means such as nuts 22 and bolts 24 as shown. Accordingly, the operator can easily guide the housing 12 along the upper perimeter of swimming pool 30 by resting wheels 16 on the pool edge and providing a slight lateral force to handle 18.

A motor 32 is also mounted to wall 20 of the housing by any suitable means such as bolts 34 which extend through the housing wall and bushings 36 into the motor itself. It should be noted that the motor is mounted over tandem wheels 16 and thus the device can easily be balanced when in use. The motor 32 has a downwardly extending shaft 40 mounting drive pulley 42. Pulley 42 engages drive belt 44 which extends into offset housing section 50 which extends away from the upright section housing 14 in a direction opposite to that of handle 18. Offset section 50 is arranged so as to extend outwardly over the upper edge of the lip surrounding pool 30 so that the majority of offset housing section 50 is actually disposed over the water in the pool. The brush shaft 60 is mounted in bearings 62 and 64 attached to the top and bottom of housing section 50. The shaft extends out of the bottom of housing section 50 for supporting brush 68 which is used to clean the upper portion of the pool shown at 70. Brush 68 has a core 72 with attached bristles 74. The shaft 60 passes through core 72. Collars 76 are attached to the top and bottom of core 72 by any suitable means and are used to connect the brush to the shaft by set screws 78 which are threaded through collars 76 and engage the shaft. Accordingly, by loosening set screws 78, the brush can be slid up and down on the shaft such that proper alignment of the brush with the pool tiles contained at and above the waterline can be maintained to facilitate proper cleaning of these tiles. Also mounted on shaft 60 is the brush pulley 79 which engages belt 44 to drive the brush. Pulley 79 rests on bushing 77 which engages lower bearing 64 to support the shaft within the housing. Another bushing shown at 75 can be placed on the shaft externally of the housing to limit upward movement of the shaft.

The housing 12 also includes a bottom wall 80 which is a plate attached to the lower portion of the housing by screws 82 which pass through the plate and engage threaded apertures in the lower portion of the housing. Accordingly, by removal of plate 80, to which wheels 16 are attached, the entire interior of the housing is accessible to facilitate the removal or repair of any components contained therein.

Also, an on/off switch 90 is attached to handle 18 at a convenient location for energizing the motor. The switch is disposed in a cord comprising lead line 95 which is attached to the switch and passes through one portion of handle 18 and into the housing.

Figure 3:
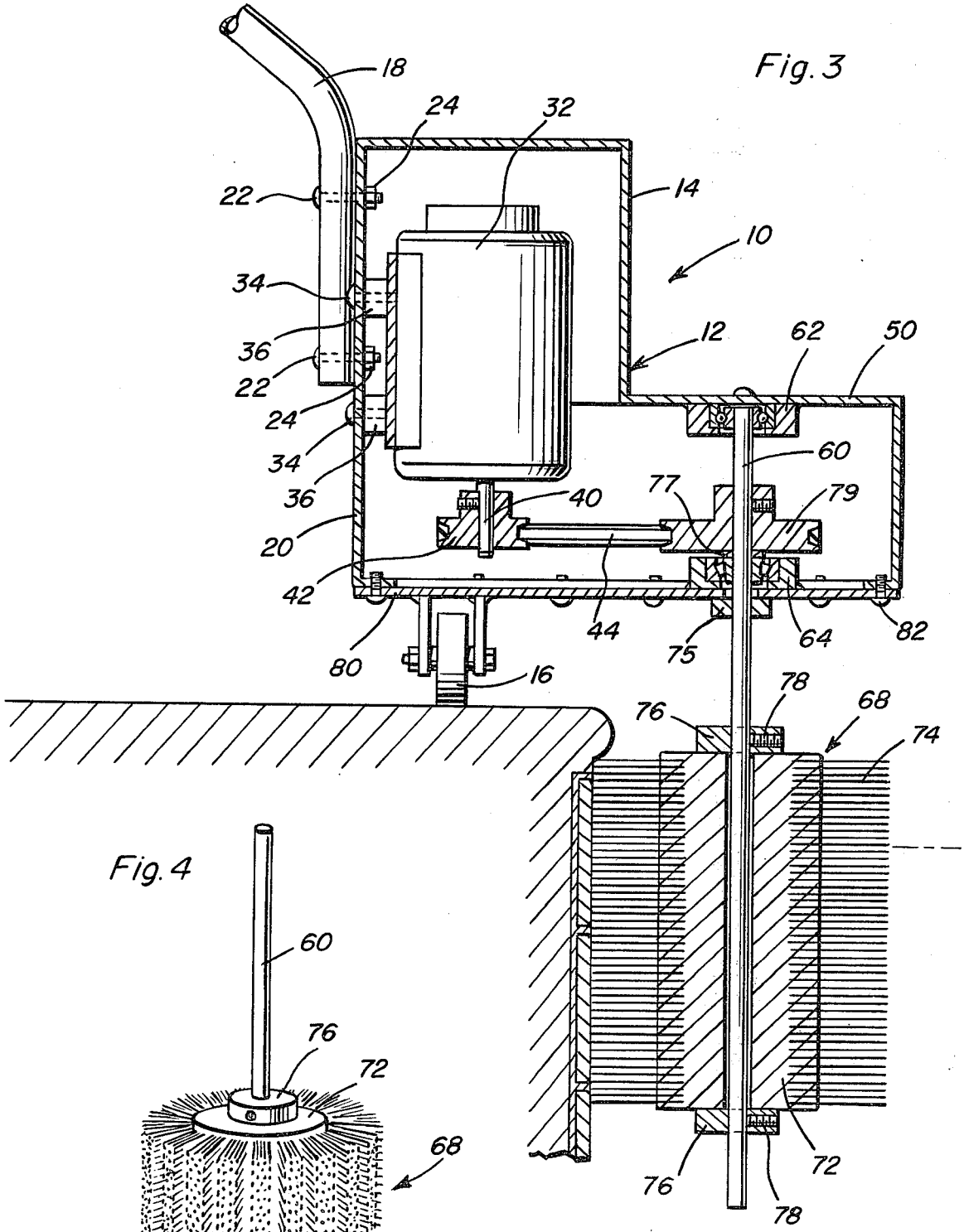
FIG. 3 is an elevational sectional view taken substantially along a section line 3—3 of FIG. 2.
Figure 4:
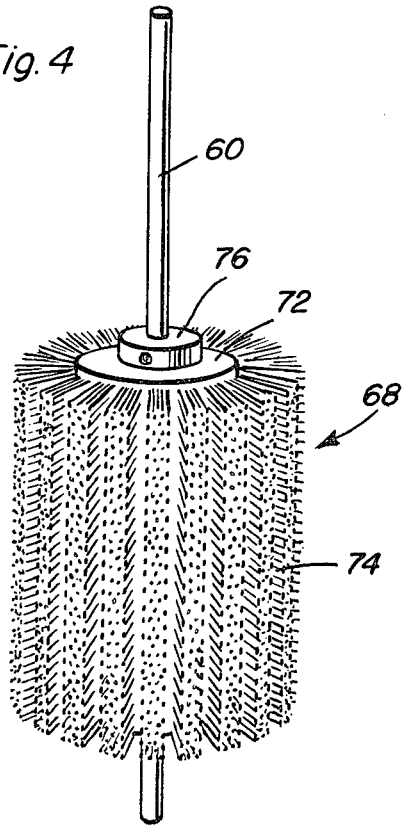
FIG. 4 is a perspective view of the brush adjustably mounted on the brush shaft.

In use, the device 10 is positioned with wheels 16 on the peripheral edge of the pool as shown in FIGS. 1 and 3 providing a moment arm force on the brush. The brush thereby presses against the tiles comprising the side wall of the pool 30 and the machine is moved sideways down the pool with the brush continually rotating to clean the tiles. Pressure of applying the moment arm onto the brush against the pool tiles can be varied by simply tipping the device forwardly thereby pushing the brush more firmly against the sides of wall. Also, by allowing the device 10 to move in the direction of the rotation of the brush, the machine actually walks itself along the wall in a self-propelled mode of operation thereby reducing the energy expended by the operator during the cleaning procedure. When not in use, the tile cleaning device can simply be laid backwards onto handle 18 in a resting position with brush 68 extended in the air to avoid damage to the bristles or the production of flat spots on the brush as would be caused if the brush were to contact the ground or any other surface.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A device for cleaning the surface of a swimming pool wall comprising:

a housing;

a handle extending rearwardly from said housing;

wheels mounted transversely and in tandem relation on the rear and bottom portion of said housing;

a brush mounted on a brush shaft extending generally vertically downwardly from a forward portion of said housing;

motor means having a downwardly extending shaft and mounted in said housing directly above said wheels for rotating said brush;

drive means extending between said motor shaft and said brush shaft and including a first pulley mounted on said motor shaft and a second pulley mounted on said brush shaft;

a belt extending around said first and second pulley;

at least one mounting collar included with the brush slidably attached to said brush shaft; and a set screw included on said mounting shaft extending radially therein for slidably mounting said collar on said shaft;

said housing being formed in two portions, one portion being a vertically extending section substantially mounted directly above the wheels containing said motor, the other portion being a forward section mounted offset from the wheels and containing said brush shaft and the motor shaft therein.

2. The invention as defined in claim 1 wherein the brush has its brushing surface engaging a vertical wall surface.

3. The invention as defined in claim 1 wherein the brush has its brushing surface engaging a vertical wall surface and rotation of the brush produces a force component for walking the device along the wall.

4. The invention as defined in claim 1 wherein the device has a rest and storing position when not in use including the handle and the rear portion of the housing.

5. The invention as defined in claim 1 wherein said motor means includes an electric motor.

6. A rotary brush for cleaning vertical wall tiles in the waterline area of the wall of a swimming pool which includes a generally horizontal deck and a rounded overhanging lip forming a juncture between the deck and wall, said brush comprising a housing extending horizontally from an area overlying the deck spaced laterally outwardly from the lip to an area spaced inwardly of the plane of the vertical pool wall, a pair of aligned wheels supported from the housing for rotation about spaced parallel horizontal axes, said wheels being disposed below the housing to engage the deck in spaced relation to the lip, upwardly extending handle means connected with said housing adjacent the location of the wheels to enable the housing to be moved along the deck and tilted about an axis defined by a line extending through the points of contact between the wheels and deck, a depending shaft supported from said housing and located remotely from the wheels and handle means and adapted to extend downwardly into the pool in spaced relation to the vertical wall and be tilted toward and away from the wall when the housing is tilted, a brush member mounted on said depending shaft, said brush member including a cyclindrical bristle surface engageable with the tiles in the waterline area, said wheels engaged with the deck and brush member engaged with the vertical pool wall defining the sole support means for the housing, a drive motor disposed in said housing in remote relation to the shaft and in overlying relation to the deck and spaced laterally outwardly of the lip, and drive means interconnecting the motor and shaft to clean the tiles of the pool wall below the lip and in the waterline area of the wall.

* * * * *